US012447584B2

(12) United States Patent
Mori et al.

(10) Patent No.: US 12,447,584 B2
(45) Date of Patent: Oct. 21, 2025

(54) SETUP METHOD

(71) Applicant: DISCO CORPORATION, Tokyo (JP)

(72) Inventors: Takenobu Mori, Tokyo (JP); Mai Haneda, Tokyo (JP); Atsushi Nakatsuka, Tokyo (JP); Atsushi Takagi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 427 days.

(21) Appl. No.: 18/047,732

(22) Filed: Oct. 19, 2022

(65) Prior Publication Data

US 2023/0126644 A1 Apr. 27, 2023

(30) Foreign Application Priority Data

Oct. 26, 2021 (JP) ..... 2021-174544

(51) Int. Cl.

| | |
|---|---|
| ***B24B 49/10*** | (2006.01) |
| ***B24B 7/07*** | (2006.01) |
| ***B24B 7/16*** | (2006.01) |
| ***B24B 49/00*** | (2012.01) |

(52) U.S. Cl.

CPC ..... *B24B 49/10* (2013.01); *B24B 7/075* (2013.01); *B24B 7/16* (2013.01); *B24B 49/006* (2013.01)

(58) Field of Classification Search

CPC ..... B24B 1/00; B24B 7/228; B24B 37/005; B24B 37/013; B24B 37/042; B24B 41/005; B24B 47/22; B24B 47/25; B24B 49/04; B24B 49/045; B24B 49/02; B24B 49/03; B24B 49/05; B24B 49/08; B24B 49/16; B24B 49/183; B24B 51/00

USPC ..... 451/5, 8, 9, 10, 41, 22, 26

See application file for complete search history.

(56) References Cited

U.S. PATENT DOCUMENTS 5,632,667 A * 5/1997 Earl ..... B24B 37/30 451/388
6,629,876 B1 * 10/2003 Park ..... B24B 55/02 451/388

FOREIGN PATENT DOCUMENTS

| | | | |
|---|---|---|---|
| JP | H03228573 | A * | 10/1991 |
| JP | H11198008 | A * | 7/1999 |
| JP | 2001001261 | A | 1/2001 |
| JP | 2008296334 | A * | 12/2008 |
| JP | 2012135853 | A | 7/2012 |
| JP | 2014039985 | A * | 3/2014 |
| JP | 2015039755 | A * | 3/2015 |
| JP | 2020019082 | A | 2/2020 |
| JP | 2020199597 | A | 12/2020 |

(Continued)

OTHER PUBLICATIONS

Translation of JP H11198008 A (Year: 1999).*

(Continued)

*Primary Examiner* — David S Posigian
*Assistant Examiner* — Steven Huang
(74) *Attorney, Agent, or Firm* — GREER BURNS & CRAIN, LTD.

(57) ABSTRACT

Stored is a height of a grinding mechanism when lower surfaces of grinding stones have come into contact with an upper surface of a wafer held on a holding surface, through lowering of the grinding mechanism from above the wafer. Based on this height, an origin point height which is a height of the grinding mechanism when the lower surfaces of the grinding stones have come into contact with the holding surface is then determined.

12 Claims, 10 Drawing Sheets

(56) References Cited

FOREIGN PATENT DOCUMENTS

JP 2021167031 A 10/2021

OTHER PUBLICATIONS

Translation of JP H03228573 A (Year: 1991).*
Translation of JP 2014039985 A (Year: 2014).*
Translation of JP 2015039755 A (Year: 2015).*
Translation of JP 2008296334 A (Year: 2008).*
Office Action issued in counterpart Singapore patent application No. 10202251400Y, dated Jun. 17, 2025.

* cited by examiner

SETUP METHOD

BACKGROUND OF THE INVENTION

Field of the Invention

The present invention relates to a setup method.

Description of the Related Art

As disclosed in JP 2001-001261A, a grinding apparatus that grinds with grinding stones a wafer held on a holding surface of a chuck table performs a setup to ascertain a height of a grinding mechanism, on which the grinding stones are mounted, when lower surfaces of the grinding stones have come into contact with the holding surface.

For such a setup, there are two cases, one using a sensor and the other a setup block, as disclosed in JP 2012-135853A and JP 2020-199597A, respectively.

SUMMARY OF THE INVENTION

In the setup that uses the setup block, however, a longer time is needed because the height of the grinding mechanism is changed to check whether or not the setup block enters between the lower surfaces of the grinding stones and the holding surface. In the setup that uses the sensor, on the other hand, the sensor is expensive.

The present invention therefore has as an object thereof the provision of a setup method which enables to perform a setup in a relatively short time without addition of a sensor.

In accordance with an aspect of the present invention, there is provided a method for setting up a grinding apparatus, the grinding apparatus including a chuck table that holds a plate-shaped workpiece on a holding surface thereof, a grinding mechanism that has grinding stones mounted thereon and grinds, with the grinding stones, the plate-shaped workpiece held on the holding surface, a lift mechanism that moves the grinding mechanism in a direction vertical to the holding surface, and a height ascertainment device that ascertains a height of the grinding mechanism moved by the lift mechanism, by moving the grinding mechanism with the lift mechanism and storing the height of the grinding mechanism when lower surfaces of the grinding stones come into contact with the holding surface. The grinding mechanism includes a contact detection section configured to detect contact of the lower surfaces of the grinding stones with an upper surface of the plate-shaped workpiece. The method includes a holding step of holding the plate-shaped workpiece on the holding surface of the chuck table such that a cushioning portion is disposed between a central area of a lower surface of the plate-shaped workpiece and the holding surface, and a storing step of storing the height of the grinding mechanism when the lower surfaces of the grinding stones are ascertained through detection by the contact detection section to have come into contact with the upper surface of the plate-shaped workpiece that is held on the holding surface, by lowering of the grinding mechanism with the grinding stones mounted thereon from above the plate-shaped workpiece held on the holding surface.

Preferably, the grinding apparatus may further include an upper-surface height gauge that measures a height of the upper surface of the plate-shaped workpiece held on the holding surface, the upper-surface height gauge may be configured to be moved together with the grinding mechanism in the direction vertical to the holding surface by the lift mechanism, and the contact detection section may be configured to detect the contact of the lower surfaces of the grinding stones with the upper surface of the plate-shaped workpiece by lowering the grinding mechanism, initiating the measurement of the height of the upper surface of the plate-shaped workpiece by the upper-surface height gauge before the lower surfaces of the grinding stones come into contact with the plate-shaped workpiece, keeping lowering the grinding mechanism to press the lower surfaces of the grinding stones against the upper surface of the plate-shaped workpiece, and ascertaining that an amount of a change in a value measured by the upper-surface height gauge no longer corresponds to an amount of a change in the height of the grinding mechanism.

Preferably, the grinding mechanism may include a rotation detection device that detects a rotational speed of the grinding stones, and the contact detection section may detect the contact of the lower surfaces of the grinding stones with the upper surface of the plate-shaped workpiece, based on a decrease in the rotational speed of the grinding stones as detected by the rotation detection device.

In this setup method, the cushioning portion in the holding step may be a cavity formed between the holding surface and the central area of the lower surface of the plate-shaped workpiece.

According to this setup method, in the storing step, the grinding mechanism is lowered from above the plate-shaped workpiece held on the holding surface, and the height of the grinding mechanism when the lower surfaces of the grinding stones have come into contact with the upper surface of the plate-shaped workpiece is stored. Based on this height, an origin point height, which is a height of the grinding mechanism when the lower surfaces of the grinding stones have come into contact with the holding surface, is then determined.

As appreciated from the foregoing, this setup method can perform, without use of a setup block, a setup to determine the origin point height of the grinding mechanism, for example, after a replacement of the grinding stones. The setup can therefore be performed in a short time. Further, the setup can be performed with an economical configuration as no setup sensor is used.

In addition, in the holding step, the cushioning portion is disposed between the central area of the lower surface of the plate-shaped workpiece and the holding surface. When the lower surfaces of the grinding stones come into contact with the upper surface of the plate-shaped workpiece, the cushioning portion undergoes a deformation to enable a reduction of an impact of the contact, thereby enabling to prevent damage to the lower surfaces of the grinding stones.

The above and other objects, features and advantages of the present invention and the manner of realizing them will become more apparent, and the invention itself will best be understood from a study of the following description and appended claims with reference to the attached drawings showing a preferred embodiment of the invention and some modifications thereof.

DETAILED DESCRIPTION OF THE PREFERRED EMBODIMENT

Figure 1:
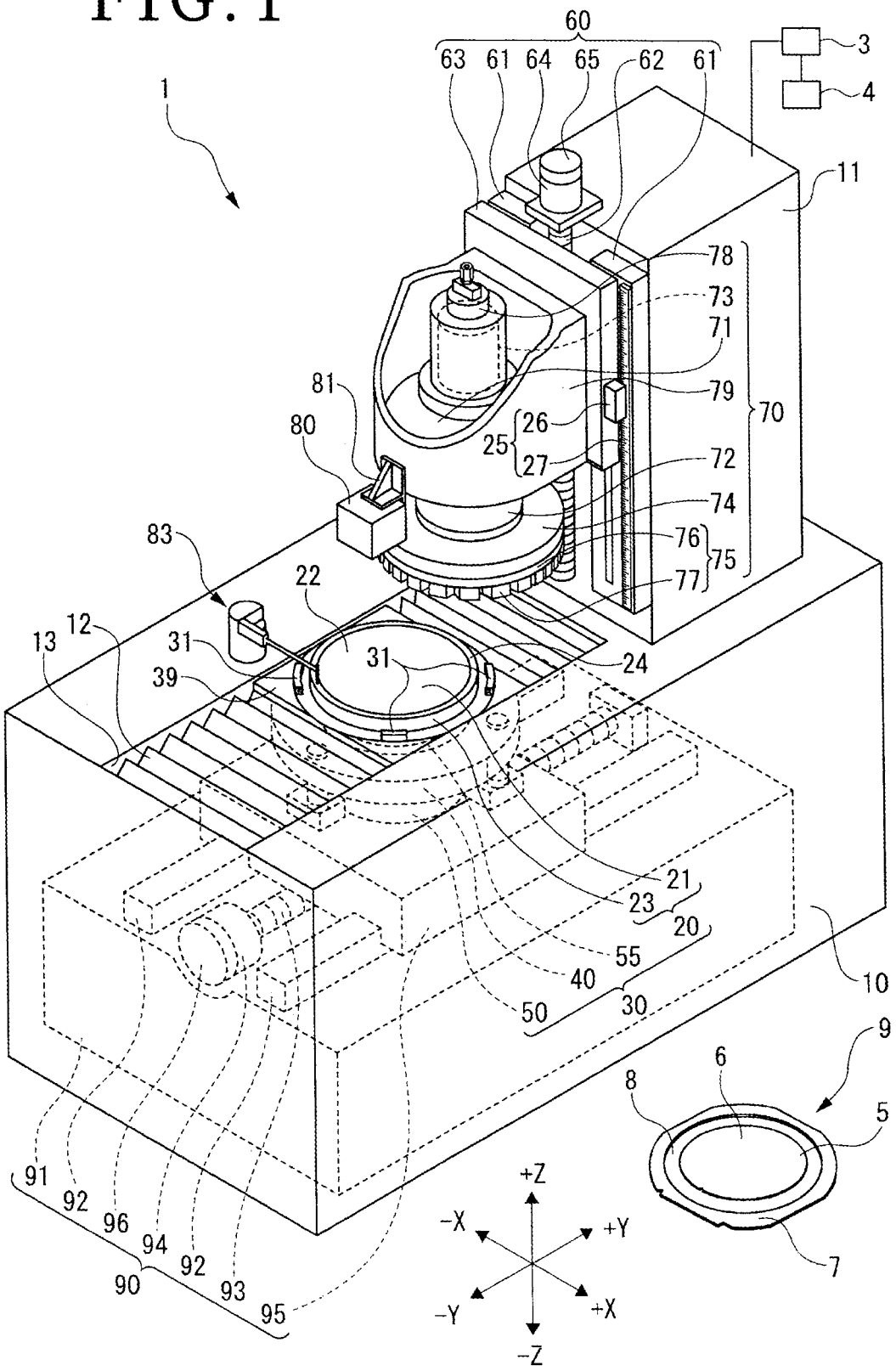
FIG. 1 is a perspective view illustrating a configuration of a grinding apparatus to which a setup method according to an embodiment of the present invention can be applied.
Figure 2:
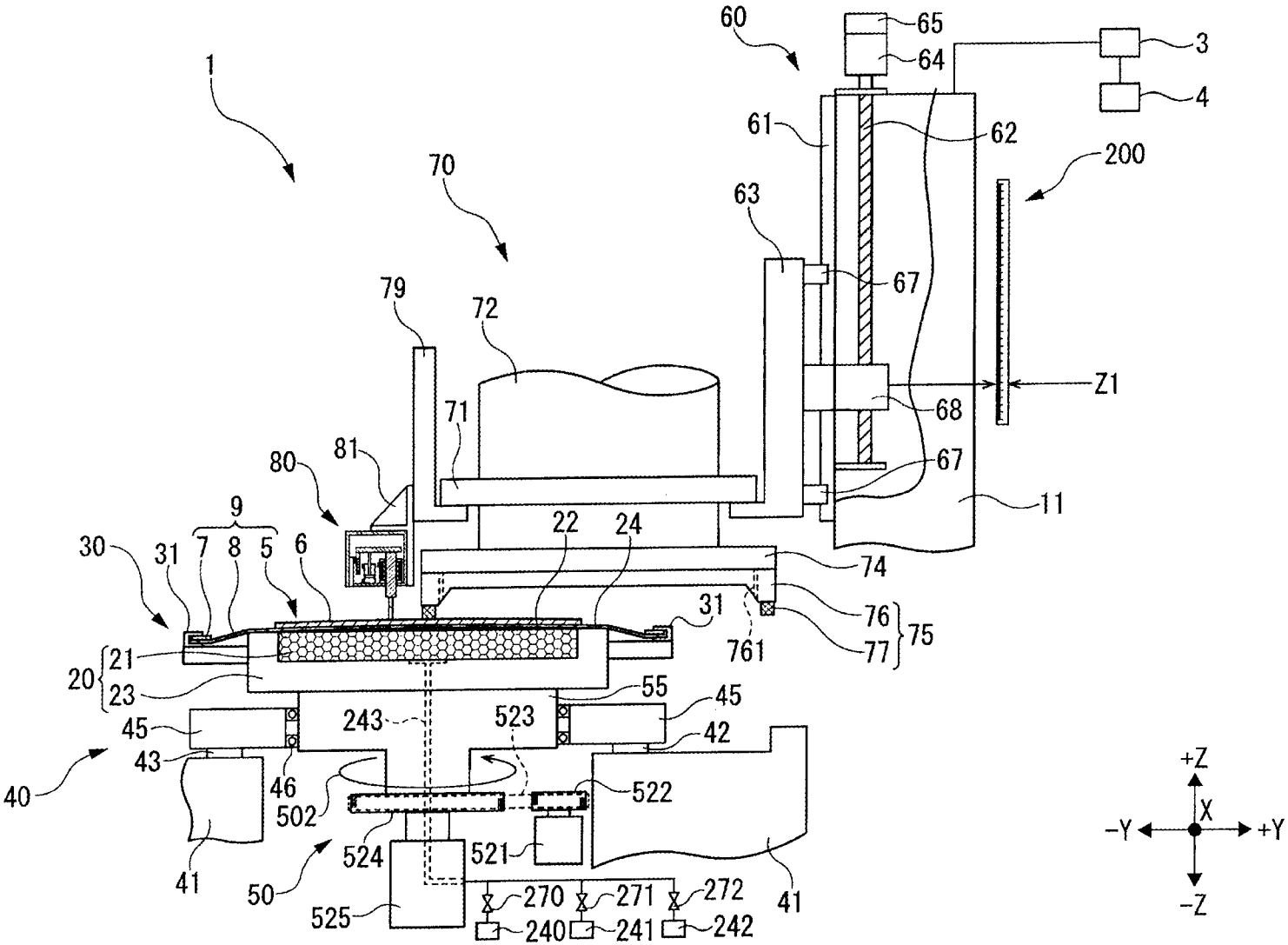
FIG. 2 is a partly cross-sectional side view illustrating the configuration of the grinding apparatus.

FIG. 1 is a perspective view illustrating a configuration of a grinding apparatus 1 to which a setup method according to an embodiment of the present invention which will be descried in detail subsequently herein can be applied. FIG. 2 is a partly cross-sectional side view illustrating the configuration of the grinding apparatus 1. The grinding apparatus 1 illustrated in FIG. 1 is used to grind a wafer 5 as an example of a plate-shaped workpiece. The wafer 5 is, for example, a circular semiconductor wafer. The wafer 5 has an upper surface 6 as a to-be-processed surface to which grinding processing is applied.

In the setup method of this embodiment, the wafer 5 is handled in a form of a frame unit 9. The frame unit 9 has been formed by integrating a ring frame 7 which has an opening large enough to accommodate the wafer 5 therein and the wafer 5 which is positioned in the opening of the ring frame 7, via a tape 8. In the setup method of this embodiment, the wafer 5 is subjected in the form of the frame unit 9 to grinding processing on the grinding apparatus 1.

As illustrated in FIG. 1, the grinding apparatus 1 includes a parallelepipedal bed 10, an upwardly extending column 11, and a controller 3 that controls individual elements of the grinding apparatus 1.

On a side of an upper surface of the bed 10, a recessed section 13 is disposed. Inside the recessed section 13, a wafer holding mechanism 30 is arranged. The wafer holding mechanism 30 includes a chuck table 20 that holds the wafer 5 on a holding surface 22 thereof, a table base 55 that supports the chuck table 20, a table rotation mechanism 50 that rotates the chuck table 20 and table base 55, and a tilt adjustment mechanism 40 that adjusts a tilt of the chuck table 20.

As illustrated in FIGS. 1 and 2, the chuck table 20 includes a porous member 21 as a wafer holding portion, and a frame body 23 with the porous member 21 accommodated therein so that the porous member 21 is exposed at an upper surface thereof. The upper surface of the porous member 21 serves as the holding surface 22 on which the wafer 5 is to be held under suction. The holding surface 22 holds the wafer 5 under suction through its communication with a suction source 240 to be mentioned subsequently herein. An upper surface of the frame body 23, that is, a frame body surface 24 is formed to be flush with the holding surface 22.

The frame body 23 includes four clamps 31 as frame holding portions for holding the ring frame 7 of the frame unit 9.

The holding surface 22 is configured to hold the wafer 5 above an upper surface of the ring frame 7 held by the clamps 31.

Below the chuck table 20, the table base 55 is disposed with the chuck table 20 supported thereon. Below the table base 55, the table rotation mechanism 50 is arranged with the table base 55 rotatably supported thereon.

As illustrated in FIG. 2, the table rotation mechanism 50 includes a motor 521, a main drive pulley 522 attached to the motor 521, a driven pulley 524 connected to the main drive pulley 522 via an endless belt 523, and a rotary joint 525 arranged below the driven pulley 524. The driven pulley 524 is supported on a lower small-diameter portion of the table base 55.

In the table rotation mechanism 50, the endless belt 523 and the driven pulley 524 are rotated when the main drive pulley 522 is rotationally driven by the motor 521. As a result, the table base 55 and chuck table 20 are rotated as indicated by an arrow 502.

Surrounding the table base 55, the tilt adjustment mechanism 40 is arranged to adjust the tilt of the chuck table 20.

The tilt adjustment mechanism 40 includes an internal base 41 arranged below the chuck table 20, two or one tilt adjustment shaft 42, one or two stationary shafts 43 fixed on the internal base 41, and an annular member 45.

The annular member 45 rotatably supports the table base 55 via a joint member 46 with bearings included therein so that the annular member 45 surrounds the table base 55.

Each stationary shaft 43 is fixed at its upper end on a lower surface of the annular member 45 and is also fixed at its lower end on an upper surface of the internal base 41.

Each tilt adjustment shaft 42 is arranged between the internal base 41 and the annular member 45, and can raise or lower a corresponding opposite portion of the annular member 45 along a Z-axis direction. The tilt of the chuck table 20 is adjusted accordingly.

In the tilt adjustment mechanism 40, the annular member 45 is supported at three locations on the internal base 41. At two of the three locations, the two tilt adjustment shafts 42 may be arranged, respectively, and at the remaining one location, the one stationary shaft 43 may be arranged, or the way around. As an alternative, the tilt adjustment mechanism 40 may not include any stationary shaft 43, and at each of the above-mentioned three locations, the tilt adjustment shaft 42 may be arranged.

A flow channel 243 is connected to the chuck table 20, and to the flow channel 243, the suction source 240, an air supply source 241, and a water supply source 242 are connected via a suction valve 270, an air valve 271, and a water valve 272, respectively.

In the grinding apparatus 1, it is hence possible to supply air or water to the holding surface 22 of the chuck table 20 and also to apply a suction force from the suction source 240 to the holding surface 22.

As illustrated in FIG. 1, a cover plate 39 is disposed surrounding the chuck table 20. The cover plate 39 is movable together with the chuck table 20 in a Y-axis direction. To the cover plate 39, bellows covers 12 are connected. The bellows covers 12 can expand and contract in the Y-axis direction. Below the wafer holding mechanism 30, a Y-axis direction moving mechanism 90 is arranged.

The Y-axis direction moving mechanism 90 relatively moves the wafer holding mechanism 30 which includes the chuck table 20, and a grinding mechanism 70 in the Y-axis direction parallel to the holding surface 22. In the setup method of this embodiment, the Y-axis direction moving mechanism 90 is configured to move the wafer holding mechanism 30 in the Y-axis direction relative to the grinding mechanism 70.

The Y-axis direction moving mechanism 90 includes a pair of Y-axis guide rails 92 parallel to the Y-axis direction, a Y-axis moving table 95 slidable on the Y-axis guide rails 92, a Y-axis ball screw 93 parallel to the Y-axis guide rails 92, a Y-axis motor 94 connected to the Y-axis ball screw 93, a Y-axis encoder 96 for detecting a rotational angle of the Y-axis motor 94, and a holding base 91 that holds these elements.

The Y-axis moving table 95 is disposed slidably on the Y-axis guide rails 92. On a lower surface of the Y-axis moving table 95, a nut portion (not illustrated) is fixed. The Y-axis ball screw 93 is maintained in threaded engagement with the nut portion. The Y-axis motor 94 is connected to one end portion of the Y-axis ball screw 93.

In the Y-axis direction moving mechanism 90, the Y-axis moving table 95 is caused to move in the Y-axis direction along the Y-axis guide rails 92 when the Y-axis ball screw 93 is rotated by the Y-axis motor 94. On the Y-axis moving table 95, the wafer holding mechanism 30 is mounted. Concomitantly with movement of the Y-axis moving table 95 in the Y-axis direction, the wafer holding mechanism 30 with the chuck table 20 included therein therefore moves in the Y-axis direction.

In the setup method of this embodiment, the wafer holding mechanism 30 is moved by the Y-axis direction moving mechanism 90 between a wafer placing region on a −Y direction side, where the wafer 5 is to be held on the holding surface 22, and a grinding region on a +Y direction side, where the wafer 5 is ground, along the Y-axis direction.

As also illustrated in FIGS. 1 and 2, the column 11 is disposed upright on a rear section (on the +Y direction side) of the bed 10. On the column 11, the grinding mechanism 70 which grinds the wafer 5, and a lift mechanism 60 are disposed.

The lift mechanism 60 moves the grinding mechanism 70 in a direction vertical to the holding surface 22 of the chuck table 20, that is, in the Z-axis direction (grinding feed direction). The lift mechanism 60 includes a pair of Z-axis guide rails 61 parallel to the Z-axis direction, a Z-axis moving table 63 slidable on the Z-axis guide rails 61, a Z-axis ball screw 62 parallel to the Z-axis guide rails 61, a Z-axis motor 64, and a Z-axis encoder 65 for detecting a rotational angle of the Z-axis motor 64. On the Z-axis moving table 63, the grinding mechanism 70 is secured.

The Z-axis moving table 63 is disposed slidably on the Z-axis guide rails 61 via slide members 67 (see FIG. 2). On the Z-axis moving table 63, a nut portion 68 (see FIG. 2) is fixed. The Z-axis ball screw 62 is maintained in threaded engagement with the nut portion 68. The Z-axis motor 64 is connected to one end portion of the Z-axis ball screw 62.

In the lift mechanism 60, the nut portion 68 and Z-axis moving table 63 are raised or lowered in the Z-axis direction along the Z-axis guide rails 61 when the Z-axis ball screw 62 is rotated by the Z-axis motor 64. The grinding mechanism 70 secured on the Z-axis moving table 63 is therefore also raised or lowered together with the Z-axis moving table 63 in the Z-axis direction.

The Z-axis encoder 65 functions as a height ascertainment device, and by detecting a rotational angle of the Z-axis motor 64, ascertains a height of the grinding mechanism 70 after its movement by the lift mechanism 60. It is to be noted that as the height of the grinding mechanism 70, the Z-axis encoder 65 determines, for example, a height of the nut portion 68 of the lift mechanism 60 that moves together with the grinding mechanism 70 in the Z-axis direction.

The grinding mechanism 70 grinds, with the grinding stones 77, the wafer 5 held on the holding surface 22 of the chuck table 20. As illustrated in FIGS. 1 and 2, the grinding mechanism 70 includes a holder 79 fixed on the Z-axis moving table 63, a spindle housing 71 held on the holder 79, a spindle 72 for rotating the grinding stones 77, a spindle motor 73 that rotationally drives the spindle 72, a rotation detection device 78 that detects a rotational speed of the grinding stones 77, a wheel mount 74 attached to a lower end of the spindle 72, and a grinding wheel 75 supported on the wheel mount 74.

The spindle 72 extends along the Z-axis direction so as to be orthogonal to the holding surface 22 of the chuck table 20 and is supported on the spindle housing 71 so as to be rotatable about an axis that extends along the extending direction of the spindle 72. The spindle motor 73 illustrated in FIG. 1 is connected to a side of an upper end of the spindle 72 and rotates the spindle 72.

The wheel mount 74 is formed in a disk shape and is fixed to the lower end of the spindle 72. The wheel mount 74 supports the grinding wheel 75.

The grinding wheel 75 is formed so that its outer diameter is substantially the same as an outer diameter of the wheel mount 74. The grinding wheel 75 includes an annular wheel base 76 formed from a metal material. Inside the wheel base 76, a processing water channel 761 is formed to supply processing water from an unillustrated water source to the grinding stones 77 (see FIG. 2).

On a lower surface of the wheel base 76, the grinding wheels 75 are arranged and fixed in an annular pattern over an entire periphery of the lower surface. The grinding stones 77 are rotated about a center thereof together with the spindle 72 by the spindle motor 73 and grind the upper surface 6 of the wafer 5 held on the chuck table 20.

The grinding apparatus 1 also has an upper-surface height gauge 80 that measures a height of the upper surface of the wafer 5 held on the holding surface 22 of the chuck table 20. The upper-surface height gauge 80 is attached to the holder 79 of the grinding mechanism 70 by an attachment member 81, and therefore is disposed on the grinding mechanism 70. The upper-surface height gauge 80 is hence moved together with the grinding mechanism 70 in the direction vertical to the holding surface 22, that is, in the Z-axis direction by the lift mechanism 60.

The upper-surface height gauge 80 needs to be configured so that by the lift mechanism 60, it is movable together with the grinding mechanism 70 in the Z-axis direction. For example, the upper-surface height gauge 80 may be disposed on a part of the lift mechanism 60, which moves up and down together with the grinding mechanism 70.

The grinding apparatus 1 further includes a contact or contactless, holding-surface height measurement gauge 83 for measuring a height of the holding surface 22 of the chuck table 20. The holding-surface height measurement gauge 83 is arranged on the bed 10 at a location beside the recessed section 13.

Figure 3:
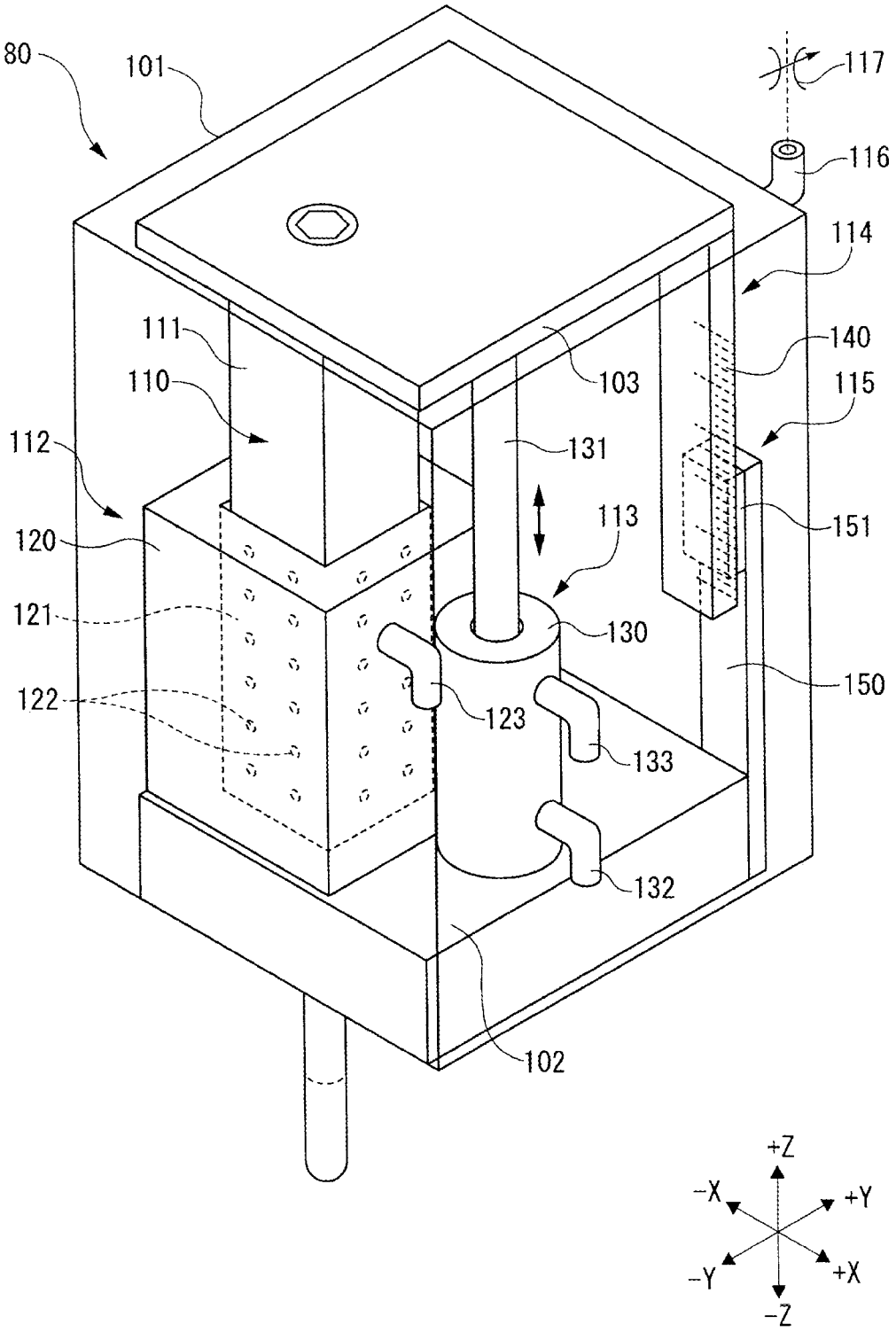
FIG. 3 is a perspective view illustrating a configuration of an upper-surface height gauge included in the grinding apparatus of FIGS. 1 and 2.
Figure 4:
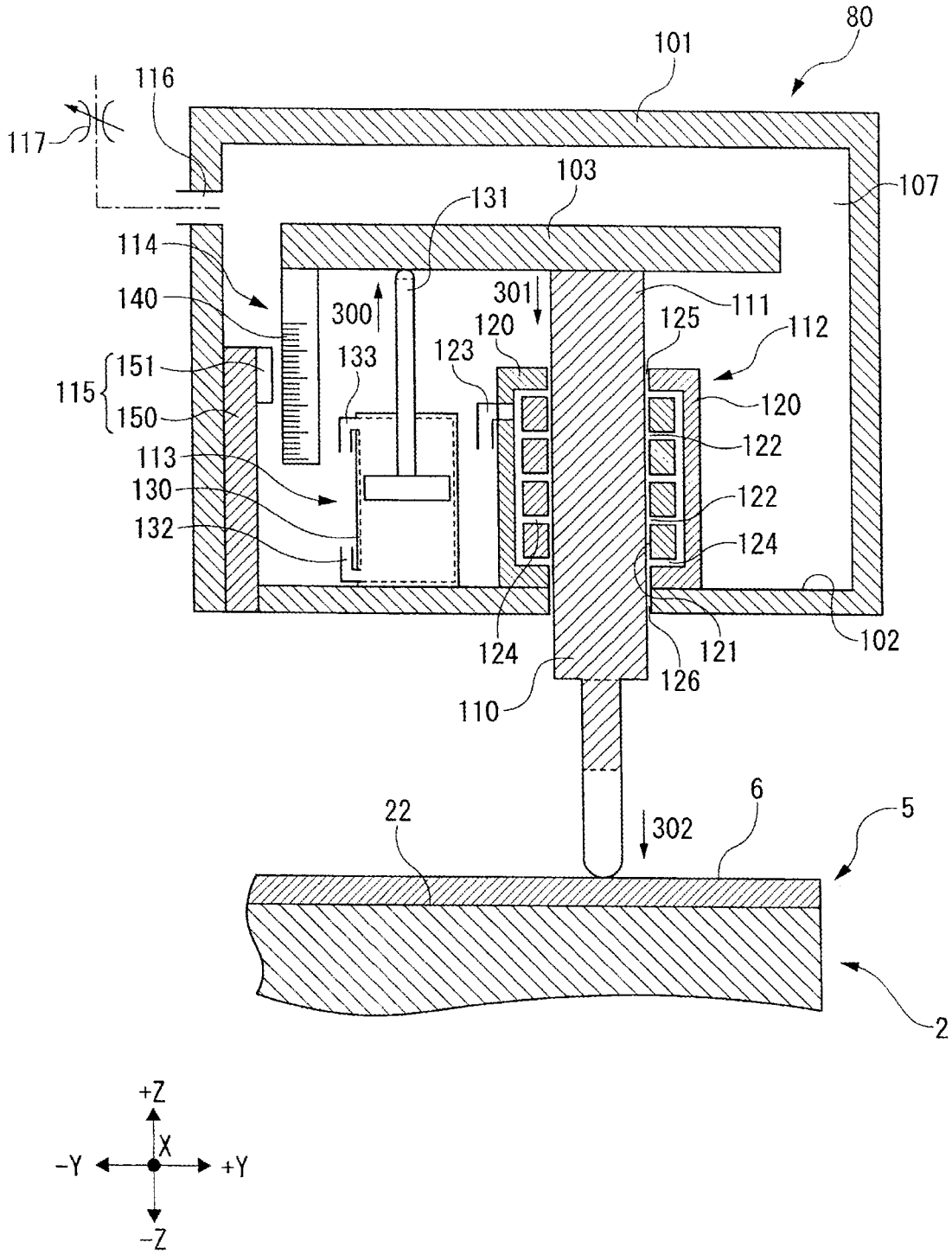
FIG. 4 is a cross-sectional view illustrating the configuration of the upper-surface height gauge.

Referring to FIGS. 3 and 4, a description will now be made about a configuration of the upper-surface height gauge 80. FIG. 3 is a perspective view illustrating the configuration of the upper-surface height gauge 80, and FIG. 4 is a cross-sectional view illustrating the configuration of the upper-surface height gauge 80. The upper-surface height gauge 80 illustrated in FIGS. 3 and 4 includes a probe 110 to be brought at a distal end thereof into contact with the upper surface 6 of the wafer 5, a housing 112 as a guide portion supporting the probe 110 movably up and down so that the probe 110 is allowed to move down under its own weight, and a scale 114 for reading a height position of the probe 110.

In the setup method of this embodiment, the upper-surface height gauge 80 also includes a moving mechanism 113 that moves the probe 110 along the Z-axis direction, a detection system 115 that reads graduations 140 of the scale 114, an exhaust port 116 and throttle valve 117 for evacuation, and a case 101 as a casing.

The probe 110 extends in the direction vertical to the holding surface 22, that is, in the Z-axis direction. The probe 110 is connected at an upper end portion thereof to a connecting member 103.

The case 101 is supported from above by the attachment member 81 illustrated in FIGS. 1 and 2. As illustrated in FIGS. 3 and 4, the probe 110 is formed in a rectangular prism shape, extends through the case 101, and downwardly projects at a distal end portion thereof from a lower surface of the case 101.

The housing 112 surrounds side surfaces 111 of the probe 110 and supports the probe 110 contactlessly and movably in the Z-axis direction vertical to the holding surface 22.

Described specifically, the housing 112 has a cylinder 120 with the probe 110 accommodated therein. The cylinder 120 is disposed on a mount surface 102 inside the case 101. In the cylinder 120, a cavity is formed in a rectangular shape in transverse cross-section corresponding to the shape of the probe 110 in transverse cross-section so that the probe 110 is accommodated in the cavity. The cylinder 120 is configured to allow extension of the probe 110 through the cavity so that the probe 110 can be supported at its periphery without contact.

The cylinder 120 also includes inner support walls 121 and a plurality of ejection nozzles 122 disposed through the support walls 121. The support walls 121 face the side surfaces 111 of the probe 110 with equal intervals maintained therebetween.

As illustrated in FIG. 4, the cylinder 120 further includes an inflow port 123 connected to an unillustrated air supply source, and flow paths 124 communicating between the inflow port 123 and the individual ejection nozzles 122.

In the housing 112, with the support walls 121 of the cylinder 120 kept facing the side surfaces 111 of the probe 110, air supplied to the inflow port 123 is blown against the side surfaces 111 of the probe 110 via the flow paths 124 and the ejection nozzles 122 disposed through the support walls 121. The housing 112 can therefore support the probe 110 with air interposed between the side surfaces 111 of the probe 110 and the support walls 121.

In the housing 112, the air flowed into the cylinder 120 is exhausted from an upper exhaust clearance 125 and a lower exhaust clearance 126 of the cylinder 120. Owing to such a construction, the housing 112 can support the probe 110 movably in the Z-axis direction without contact.

The exhaust port 116 exhausts, to outside the case 101, the air exhausted from the housing 112 into the case 101. The throttle valve 117 connected to the exhaust port 116 controls an evacuation rate of air to adjust the pressure inside the case 101, thereby adjusting a pressing force of the probe 110 against the upper surface 6 of the wafer 5.

The moving mechanism 113 is disposed on the mount surface 102 of the case 101 at a location near the probe 110. The moving mechanism 113 includes a cylinder 130 and a piston 131. Inside the cylinder 130, the piston 131 moves in the Z-axis direction parallel to an axial direction of the probe 110.

The moving mechanism 113 also includes inflow ports 132 and 133 in the cylinder 130 for causing air to flow into the cylinder 130. The moving mechanism 113 of such a construction as described above can move the probe 110 in the Z-axis direction via the connecting member 103 by moving the piston 131 linearly in the Z-axis direction.

Described specifically, when desired to raise the probe 110 in a +Z direction by the moving mechanism 113, air from the unillustrated air supply is supplied into the cylinder 130 via the inflow port 132. The piston 131 hence moves up inside the cylinder 130. The piston 131 then comes into contact with the connecting member 103, and raises the connecting member 103, whereby the probe 110 connected to the connecting member 103 is raised.

When desired to lower the probe 110 by the moving mechanism 113, on the other hand, air from the unillustrated air supply source is supplied into the cylinder 130 via the inflow port 133. The piston 131 therefore moves down inside the cylinder 130. Concomitantly with this, the probe 110 moves down under the own weight of the probe 110 and that of the connecting member 103 connected to probe 110.

The moving mechanism 113 can also restrict the moving-down speed of the probe 110 by adjusting the moving-down speed of the piston 131 through control of the inflow rate of air from the inflow port 133. Further, the moving mechanism 113 can lower the probe 110 until the distal end of the probe 110 comes into contact with a surface below the probe 110, for example, the upper surface 6 of the wafer 5 held on the holding surface 22 of the chuck table 20.

As illustrated in FIGS. 3 and 4, the scale 114 is suspended from an end portion of the connecting member 103 and is disposed in parallel with an extending direction of the probe 110, that is, Z-axis direction. The scale 114 is connected to the probe 110 via the connecting member 103 and is therefore movable together with the probe 110 in the Z-axis direction.

The detection system 115 is attached to a lower end portion of the case 101. The detection system 115 includes a support plate 150 extending in the Z-axis direction and a detection unit 151 disposed on an upper end of the support plate 150. The detection unit 151 faces the graduations 140 of the scale 114 and reads the graduations 140. The detection unit 151 can therefore detect the height of the probe 110, which is in contact with the upper surface 6 of the wafer 5, by reading opposite one of the graduations 104 of the scale 114 that moves together with the probe 110 in the Z-axis direction.

The controller 3 illustrated in FIGS. 1 and 2 includes a central processing unit (CPU), a memory, and so on, and controls the individual elements of the grinding apparatus 1 to perform a setup of the grinding mechanism 70 and grinding processing on the wafer 5. The controller 3 also functions as a contact detection section that detects contact of the lower surfaces of the grinding stones 77 in the grinding mechanism 70 with the upper surface 6 of the wafer 5 held on the holding surface 22 of the chuck table 20. To the controller 3, a storage section 4 is connected to store a measured value or the like of the height of the grinding mechanism 70.

A description will hereinafter be made about the setup method of this embodiment for the grinding mechanism 70. This setup method is performed, for example, after a replacement of the grinding stones 77. This setup method moves the grinding mechanism 70 by the lift mechanism 60 and stores a height of the grinding mechanism 70 when the lower surfaces of the grinding stones 77 have come into contact with the holding surface 22 of the chuck table 20.

[Holding Step]

In a holding step, the holding surface 22 of the chuck table 20 holds the wafer 5 so that a cushioning portion is arranged between a central area 51 (see FIG. 6) of the lower surface of the wafer 5 as the plate-shaped workpiece and the holding surface 22.

Described specifically, as illustrated in FIG. 2, an operator first places the wafer 5 in the frame unit 9 on the holding surface 22 of the chuck table 20 via the tape 8 and holds the ring frame 7 of the frame unit 9 by the clamps 31. The frame unit 9 with the wafer 5 included therein is therefore held and supported on the chuck table 20.

Using the Y-axis direction moving mechanism 90 illustrated in FIG. 1, the controller 3 next adjusts the position of the chuck table 20 so that the grinding stones 77 are positioned around and near a center of the wafer 5 held on the holding surface 22 of the chuck table 20.

After that, using the lift mechanism 60, the controller 3 lowers the grinding mechanism 70, with the grinding stones 77 secured thereon, and the upper-surface height gauge 80 from above the wafer 5 held on the holding surface 22. Here, the controller 3 keeps the probe 110 of the upper-surface height gauge 80 suspended under its own weight from the case 101.

Figure 5:
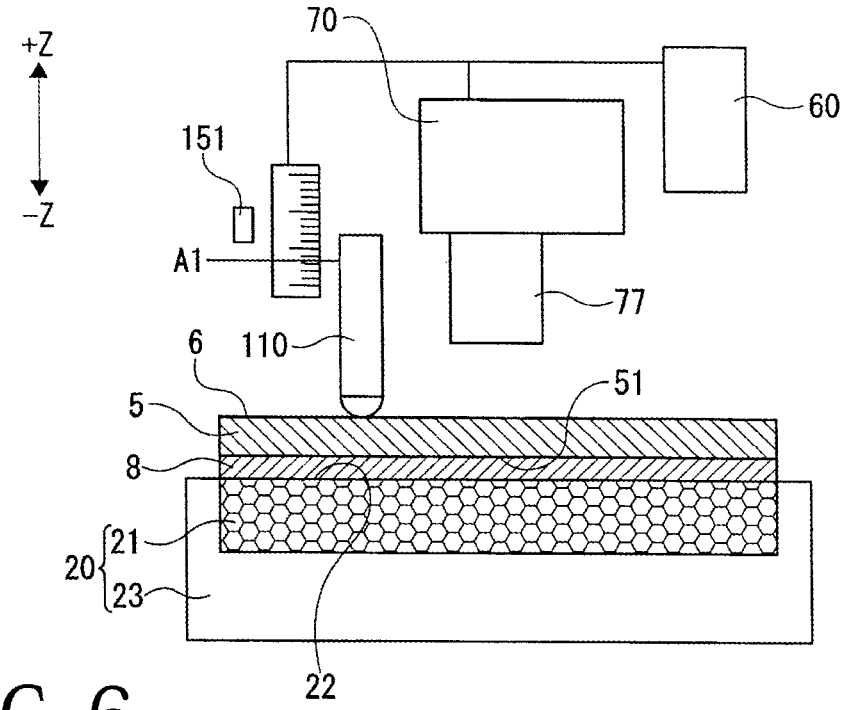
FIG. 5 is a schematic view illustrating a holding step of the setup method in a stage where a distal end of a probe has come into contact with an upper surface of a wafer as a plate-shaped workpiece.
Figure 6:
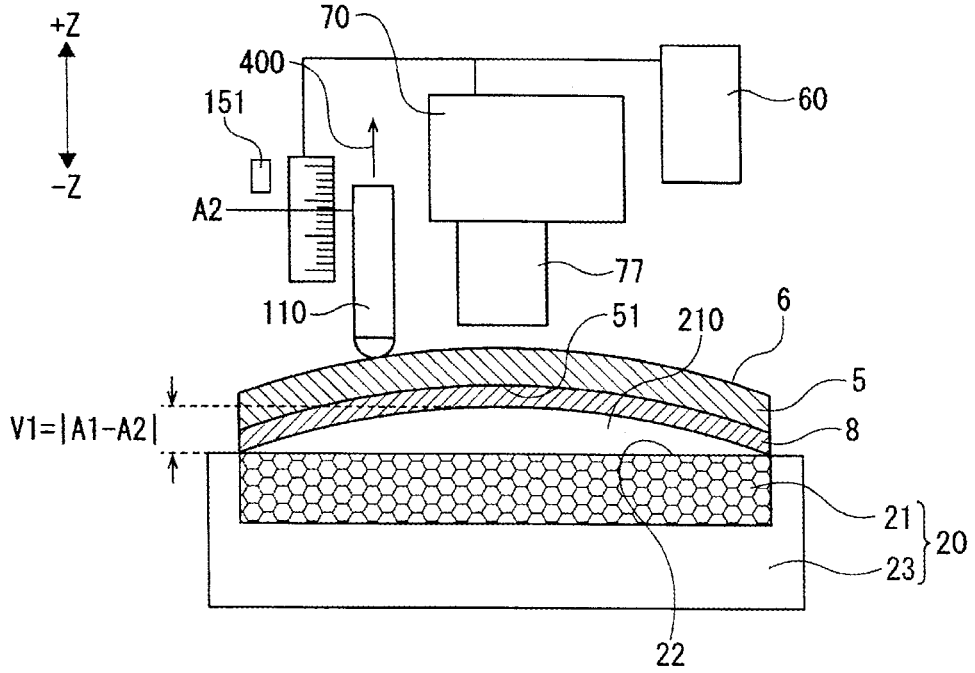
FIG. 6 is a schematic view illustrating the holding step in a stage where a cavity has been formed as a cushioning portion between a holding surface and a central area of a lower surface of the wafer.
Figure 7:
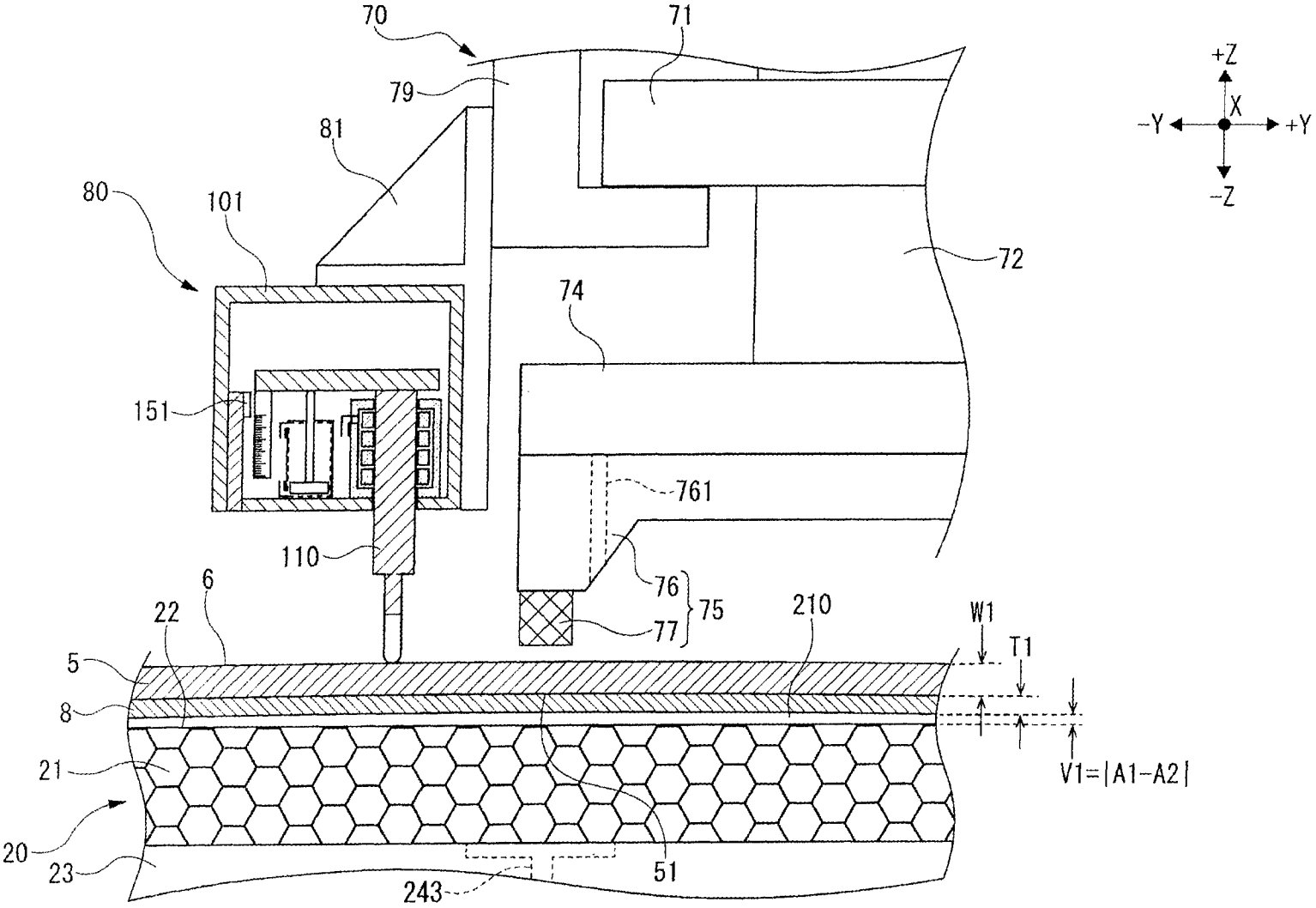
FIG. 7 is an enlarged fragmentary cross-sectional view illustrating the holding step in the same stage as in FIG. 5.

Reference is next had to FIG. 5 to FIG. 7. FIG. 5 is a schematic view illustrating the holding step in a stage where the distal end of the probe 110 has come into contact with the upper surface 6 of the wafer 5, FIG. 6 is a schematic view illustrating the holding step in a stage where a cavity 210 has been formed as the cushioning portion between the holding surface 22 and the central area 51 of the lower surface of the wafer 5, and FIG. 7 is an enlarged fragmentary cross-sectional view illustrating the holding step in the same stage as in FIG. 5.

When the probe 110 is suspended from the case 101 under its own weight and the grinding mechanism 70 and upper-surface height gauge 80 are lowered as described above, the distal end of the probe 110, as illustrated in FIG. 5, comes into contact with the upper surface 6 of the wafer 5 before the lower surfaces of the grinding stones 77 do.

When the grinding mechanism 70 and upper-surface height gauge 80 are lowered and the distal end of the probe 110 comes into contact with the upper surface 6 of the wafer 5, the probe 110 moves up in the +Z direction relative to the case 101 (see FIG. 4), and a height change of the probe 110 in the +Z direction is detected by the detection unit 151. Based on the detection of this height change of the probe 110 in the +Z direction, the controller 3 detects that the distal end of the probe 110 has come into contact with the upper surface 6 of the wafer 5. The controller 3 then stops the lowering of the grinding mechanism 70 and upper-surface height gauge 80 by the lift mechanism 60, and acquires, as a first measured value A1, a height of the probe 110 as detected by the detection unit 151 of the upper-surface height gauge 80.

The controller 3 next controls the air valve 271 (see FIG. 2) to bring the air supply source 241 into communication with the holding surface 22 of the chuck table 20, whereby an airblow from the holding surface 22 is initiated. Air from the holding surface 22 of the chuck table 20 is therefore blown against the tape 8 of the frame unit 9 that is located opposite the holding surface 22. As a result, the tape 8 and wafer 5 are lifted in the +Z-direction, and as illustrated in FIG. 6, the cavity 210 is formed as the cushioning portion between the holding surface 22 and the central area 51 of the lower surface of the wafer 5. As an alternative, water may be ejected from the holding surface 22 to form the cushioning portion.

As described above, the holding surface 22 holds the wafer 5 in the holding step so that the cavity 210 is formed and arranged as the cushioning portion between the central area 51 of the lower surface of the wafer 5 and the holding surface 22 as illustrated in FIGS. 6 and 7.

Owing to the formation of the cavity 210, the probe 110 which is in contact with the upper surface 6 of the wafer 5 moves up in the +Z direction as indicated by an arrow 400 in FIG. 6. The controller 3 detects the height of the moved-up probe 110 by the detection unit 151 of the upper-surface height gauge 80 and acquires it as a second measured value A2. Further, the controller 3 determines the difference (|A1−A2|) between the first measured value A1 and the second measured value A2, and ascertains this difference as a thickness V1 of the cavity 210.

It is to be noted that for preventing the lower surfaces of the grinding stones 77 from coming into contact with the upper surface 6 of the wafer 5 when the probe 110 is raised by the formation of the cavity 210, the probe 110 is suspended from the case 101 to position the distal end of the probe 110 lower than the lower surfaces of the grinding stones 77 beforehand.

[Storing Step]

Figure 8:
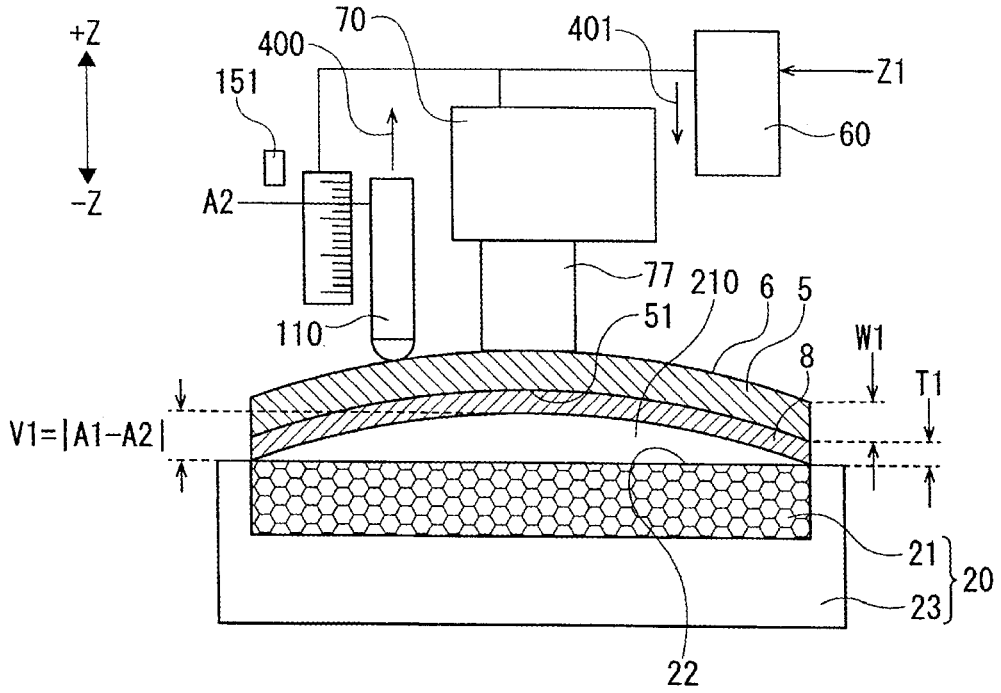
FIG. 8 is a schematic view illustrating a storing step of the setup method in a stage where a grinding mechanism included in the grinding apparatus has been kept lowered from the stage of FIG. 6.
Figure 9:
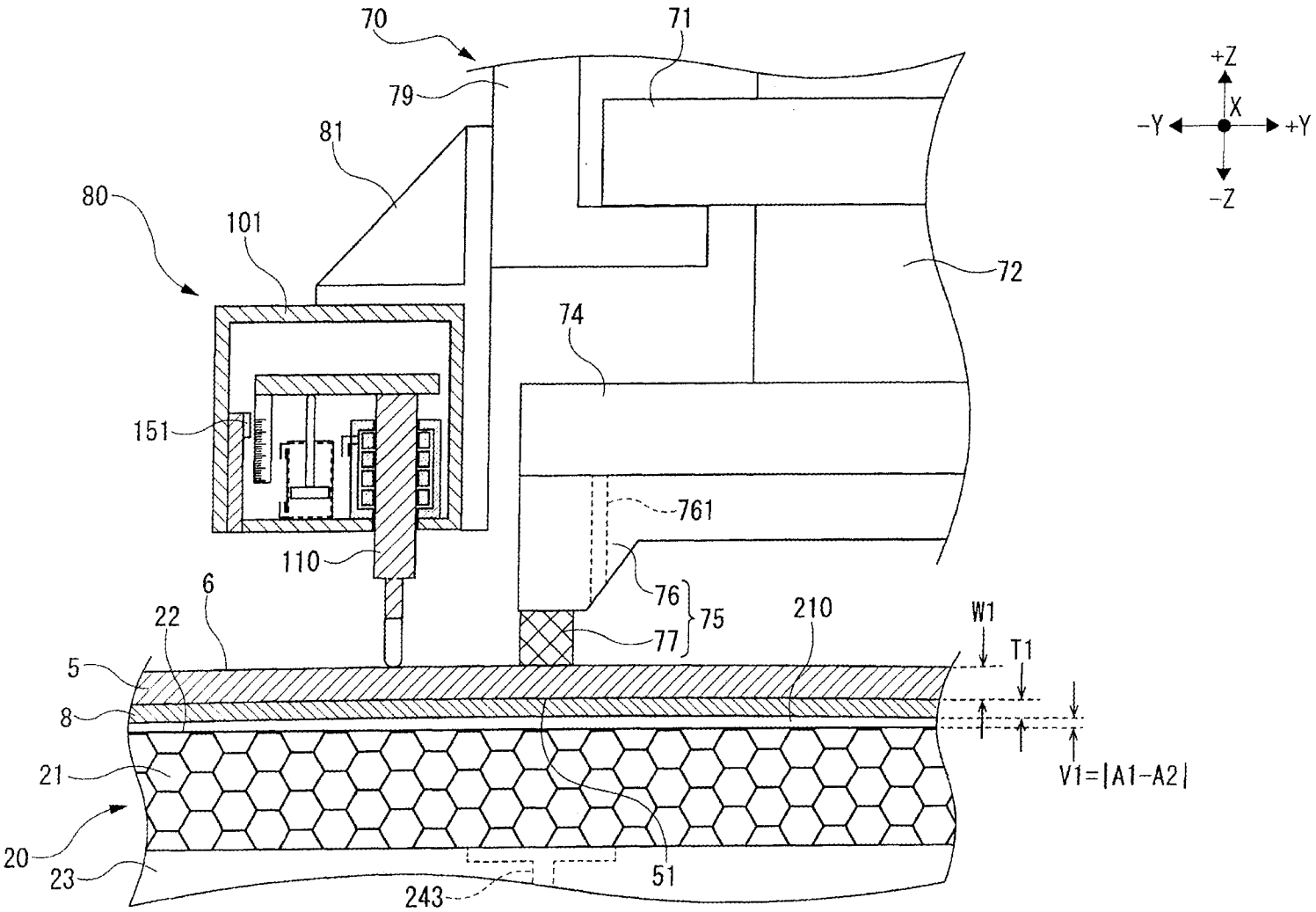
FIG. 9 is an enlarged fragmentary cross-sectional view illustrating the storing step in a stage where the cavity has been collapsed by grinding stones in association with further lowering of the grinding mechanism.

With reference to FIGS. 8 and 9, a description will next be made of a storing step in the setup method of this embodiment. FIG. 8 is a schematic view illustrating the storing step in a stage where the grinding mechanism 70 has been kept lowered from the stage of FIG. 6, and FIG. 9 is an enlarged fragmentary cross-sectional view illustrating the storing step in a stage where the cavity 210 has been collapsed by the grinding stones 77 in association with further lowering of the grinding mechanism 70.

Using the lift mechanism 60, the controller 3 then resumes the lowering of the grinding mechanism 70 from above the wafer 5 which is held on the holding surface 22 to bring the lower surfaces of the grinding stones 77 into contact with the upper surface 6 of the wafer 5.

As mentioned above, at this time, the distal end of the probe 110 has already come into contact with the upper surface 6 of the wafer 5 before the lower surfaces of the grinding stones 77 come into contact. The controller 3 has therefore already initiated the measurement of the upper-surface height of the upper surface 6 of the wafer 5 by the upper-surface height gauge 80 before the lower surfaces of the grinding stones 77 come into contact with the wafer 5.

Using the lift mechanism 60, the controller 3 continuously lowers the grinding mechanism 70 as indicated by an arrow 401 in FIG. 8. As illustrated in FIGS. 8 and 9, until the lower surfaces of the grinding stones 77 come into contact with the upper surface 6 of the wafer 5 and press the upper surface 6, the probe 110 moves up relative to the case 101 in association with the lowering of the grinding mechanism 70, so that the height of the probe 110 as detected by the detection unit 151 changes in the +Z direction (see the arrow 400 in FIG. 8). Described specifically, until the lower surfaces of the grinding stones 77 come into contact with the upper surface 6 of the wafer 5, the measured value of the upper-surface height gauge 80 changes in the +Z direction by the same amount as that of a change in the height of the grinding mechanism 70 per unit time in a −Z direction as ascertained by the Z-axis encoder 65. Changes in the measured value of the upper-surface height gauge 80 hence correspond to those in the height of the grinding mechanism 70.

After the lower surfaces of the grinding stones 77 have come into contact with the upper surface 6 of the wafer 5, the cavity 210 is collapsed by the grinding stones 77 in association with lowering of the grinding mechanism 70, so that the upper surface 6 of the wafer 5 begins to move down in the −Z direction. The distal end of the probe 110 which is in contact with the upper surface 6 therefore also begins to move down in the −Z direction. The probe 110 which has moved up relative to the case 101, hence moves down in association with the lowering of the grinding mechanism 70. The amount of the change in the +Z direction of the measured value of the upper-surface height gauge 80 per unit time therefore is no longer the same as the amount of the change in the −Z direction of the height of the grinding mechanism 70 per unit time. In other words, changes in the measured value of the upper-surface height gauge 80 no longer correspond to those in the height of the grinding mechanism 70.

The controller 3 then ascertains that changes in the measured value of the upper-surface height gauge 80 no longer correspond to changes in the height of the grinding mechanism 70 due to the pressing of the upper surface 6 of the wafer 5 by the lower surfaces of the grinding stones 77, and therefore detects that the lower surfaces of the grinding stones 77 have come into contact with the upper surface 6 of the wafer 5 held on the holding surface 22. At this time, the controller 3 stops the lowering of the grinding mechanism 70 by the lift mechanism 60 acquires as a first height Z1 (see FIG. 8) the value of a height of the grinding mechanism 70 as ascertained by the Z-axis encoder 65, and stores it in the memory of the controller 3 and/or the storage section 4. It is to be noted that a virtual scale 200 which indicates the height of the grinding mechanism 70 as ascertained by the Z-axis encoder 65 is illustrated in FIG. 2. Subsequently, the controller 3 raises the grinding mechanism 70 using the lift mechanism 60.

Based on the thus-acquired first height Z1 of the grinding mechanism 70, the controller 3 next determines the height of the grinding mechanism 70 when the lower surfaces of the grinding stones 77 have come into contact with the holding surface 22 of the chuck table 20, in other words, the origin point height Z0 of the grinding mechanism 70.

Described specifically, the controller 3 calculates the origin point height Z0 of the grinding mechanism 70 by subtracting the above-mentioned thickness V1 of the cavity 210 and a thickness W1 of the wafer 5 and a thickness T1 of the tape 8 (see FIGS. 8 and 9), the thicknesses W1 and T1 being known beforehand, from the first height Z1 of the grinding mechanism 70 as indicated by the following equation (1).

[Math. 1]

$$Z0=Z1-V1-W1-T1 \quad (1)$$

As described above, in this step, the controller 3 has already stopped the lowering of the grinding mechanism 70 and acquired the first height Z1 when the lower surfaces of the grinding stones 77 come into contact with the upper surface 6 of the wafer 5 and the cavity 210 begins to be collapsed by the grinding stones 77 as illustrated in FIGS. 8 and 9. The thickness of the cavity 210 therefore has undergone substantially no changes. The wafer 5, the tape 8, and the cavity 210 hence exist between the lower surfaces of the grinding stones 77 and the holding surface 22 when the lower surfaces of the grinding stones 77 come into contact with the upper surface 6 of the wafer 5 and the first height Z1 of the grinding mechanism 70 is acquired.

The controller 3 can therefore acquire the height of the grinding mechanism 70 when the lower surfaces of the grinding stones 77 have come into contact with the holding surface 22 of the chuck table 20, in other words, the origin point height Z0 of the grinding mechanism 70 by subtracting the thicknesses of the wafer 5, the tape 8, and the cavity 210 from the first height Z1 by the calculation indicated above in the equation (1). The controller 3 stores the thus-acquired origin point height Z0 of the grinding mechanism 70 in the memory of the controller 3 and/or the storage section 4.

As described above, in the storing step in this embodiment, the grinding mechanism 70 is lowered from above the wafer 5 held on the holding surface 22, and when the lower surfaces of the grinding stones 77 have come into contact with the upper surface 6 of the wafer 5, the height of the grinding mechanism 70 is stored. Based on this height, the origin point height Z0 of the grinding mechanism 70 is then determined.

In this embodiment, a setup can hence be performed to determine the origin point height Z0 of the grinding mechanism 70 without using any setup block, for example, after the grinding stones 77 have been replaced. The setup can hence be performed in a short time. In addition, the use of the wafer 5 in the setup enables to grind the wafer 5 following the setup. It is thus possible to improve efficiency of work from the setup to the grinding step. As no setup sensor is used, the setup can be performed by an economical equipment configuration.

Further, in this embodiment, the cavity 210 is formed as the cushioning portion between the central area 51 of the lower surface of the wafer 5 and the holding surface 22 in the holding step. When the lower surfaces of the grinding stones 77 come into contact with the upper surface 6 of the wafer 5, the cavity 210 undergoes a deformation to enable a reduction of an impact of the contact, thereby enabling to prevent damage to the lower surfaces of the grinding stones 77.

Figure 10:
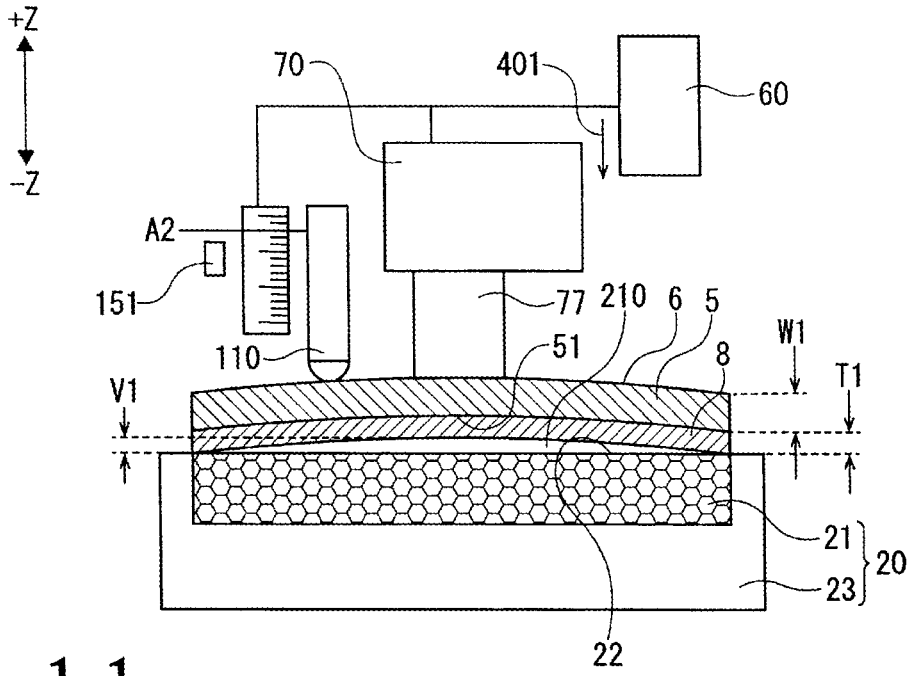
FIG. 10 is a schematic view illustrating a first modification of the storing step of FIGS. 8 and 9.
Figure 11:
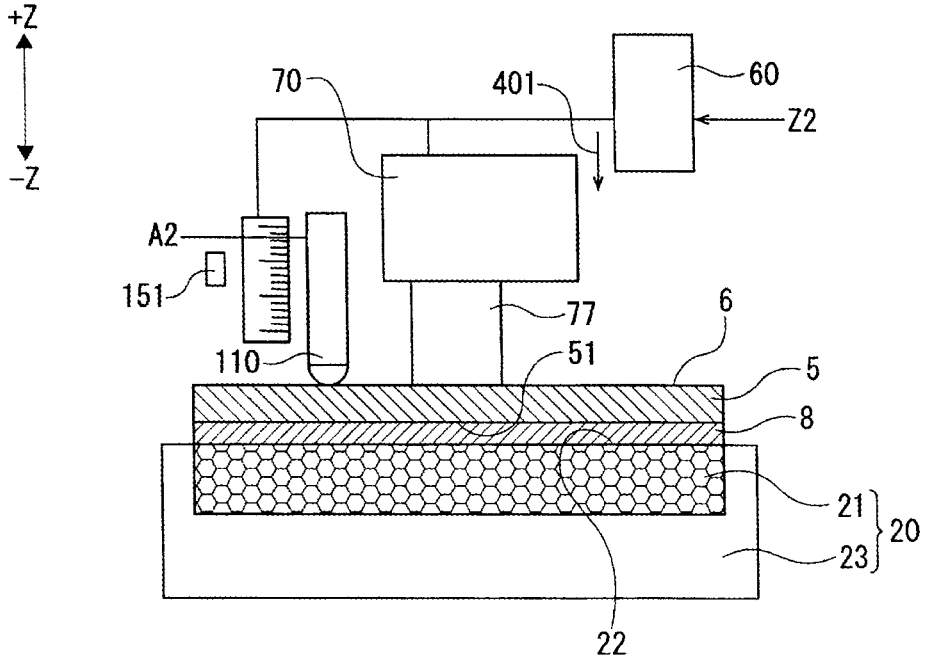
FIG. 11 is a schematic view illustrating a second modification of the storing step of FIGS. 8 and 9.

Referring to FIGS. 10 and 11, a description will now be made of a first modification and a second modification of the storing step of FIGS. 8 and 9. FIG. 10 is a schematic view illustrating the first modification of the storing step of FIGS. 8 and 9, and FIG. 11 is a schematic view illustrating the second modification of the storing step of FIGS. 8 and 9.

When stopping the lowering of the grinding mechanism 70 and acquiring the first height Z1, there may be a situation where as illustrated in FIG. 10, the cavity 210 has been substantially collapsed by the grinding stones 77 and the thickness V1 of the cavity 210 has changed significantly. In this situation, the controller 3 performs the calculation indicated above by the equation (1) after correcting the V1 according to the amount of the change in the thickness of the cavity 210.

When stopping the lowering of the grinding mechanism 70 and acquiring the first height Z1, there may be another situation where as illustrated in FIG. 11, the cavity 210 has been completely collapsed by the grinding stones 77 and the tape 8 is in contact with the holding surface 22. In this situation, the origin point height Z0 of the grinding mechanism 70 is calculated by subtracting the thickness W1 of the wafer 5 and the thickness T1 of the tape 8, the thicknesses W1 and T1 being known beforehand, from the first height Z1 which is the height of the grinding mechanism 70 when the lower surfaces of the grinding stones 77 have come into contact with the upper surface 6 of the wafer 5, according to the following equation (2) instead of the above-mentioned equation (1).

[Math. 2]

$$Z0=Z1-W1-T1 \quad (2)$$

As a further alternative, after acquiring the first height Z1 before the thickness of the cavity 210 begins to change, the lowering of the grinding mechanism 70 may be resumed. When the cavity 210 has been completely collapsed by the grinding stones 77, the lowering of the grinding mechanism 70 may be stopped, followed by acquisition of a second height Z2 of the grinding mechanism 70 as illustrated in FIG. 11. The thickness V1 of the cavity 210 may then be determined by subtracting the second height Z2 from the first height Z1 as indicated by the following equation (3).

[Math. 3]

$$V1=|(Z1-Z2)| \quad (3)$$

It is to be noted that the cavity 210 is detected to have been completely collapsed when the amount of a change of the upper-surface height gauge 80 in the +Z direction per unit time has become the same as and corresponding to the amount of a change in the height of the grinding mechanism 70 in the −Z direction per unit time.

In this embodiment, relying upon that the measured value of the upper-surface height gauge 80 no longer changes, the controller 3 as the contact detection section detects that the lower surfaces of the grinding stones 77 have come into contact with the upper surface 6 of the wafer 5, and determines as the first height Z1 the height of the grinding mechanism 70 at that time.

In this respect, the controller 3 may use the rotation detection device 78 illustrated in FIG. 1 to detect that the lower surfaces of the grinding stones 77 have come into contact with the upper surface 6 of the wafer 5. As mentioned above, the rotation detection device 78 detects the rotational speed of the grinding stones 77. In this embodiment, the rotation detection device 78 detects, as the rotational speed of the grinding stones 77, the rotational speed of the spindle 72 on which the grinding stones 77 are secured via the grinding wheel 75 and wheel base 76.

With this configuration, when lowering the grinding mechanism 70 from above the wafer 5 held on the holding surface 22 in the storing step, the controller 3 controls the spindle motor 73 to rotate the spindle 72 and the grinding stones 77 secured on the distal end of the spindle 72 via the grinding wheel 75 and wheel base 76, and also detects the rotational speed of the spindle 72 using the rotation detection device 78.

Here, the controller 3 stops the spindle motor 73 before the lower surfaces of the grinding stones 77 come into contact with the upper surface 6 of the wafer 5 and allows the spindle 72 to undergo inertial rotation.

In association with the lowering of the grinding mechanism 70, the lower surfaces of the grinding stones 77 then come into contact with the upper surface 6 of the wafer 5 and press the upper surface 6. Due to friction resistance between the grinding stones 77 and the upper surface 6 of the wafer 5, the rotational speed of the spindle 72 as detected by the rotation detection device 78 therefore decreases. Based on the decrease in the rotational speed of the spindle 72 as detected by the rotation detection device 78, the controller 3 then detects that the lower surfaces of the grinding stones 77 have come into contact with the upper surface 6 of the wafer 5. Here, the controller 3 stops the lowering of the grinding mechanism 70 by the lift mechanism 60 and can acquire as the first height Z1 the value of the height of the grinding mechanism 70 as ascertained by the Z-axis encoder 65.

With this configuration, the cavity 210 can also deform and reduce an impact of contact when the lower surfaces of the rotating grinding stones 77 come into contact with the upper surface 6 of the wafer 5. It is therefore possible to prevent damage to the lower surfaces of the grinding stones 77.

As an alternative, the rotation detection device 78 may be configured to detect electric power to be consumed by the spindle motor 73 for rotating the spindle 72. If this is the case, before the lower surfaces of the grinding stones 77 come into contact with the upper surface 6 of the wafer 5, the spindle 72 is allowed to rotate freely so that the power consumption of the spindle motor 73 as detected by the rotation detection device 78 remains relatively small.

When the lower surfaces of the grinding stones 77 come into contact with the upper surface 6 of the wafer 5 and press the upper surface 6, on the other hand, the power consumption of the spindle motor 73 as detected by the rotation detection device 78 increases to a relatively large value due to the above-mentioned friction resistance. Based on this increase in the power consumption as detected by the rotation detection device 78, the controller 3 can then detect that the lower surfaces of the grinding stones 77 have come into contact with the upper surface 6 of the wafer 5. It is to be noted that the rotation detection device 78 may also be configured to detect a load current value of the spindle motor 73 as the power consumption of the spindle motor 73.

The rotation detection device 78 may include a disk disposed on the upper end of the spindle 72 and defining slits formed therein, and a sensor that detects the slits (both not illustrated). In this case, the rotation detection device 78 can determine the rotational speed of the spindle 72 by detecting, with the sensor, the slits in the disk rotating together with the spindle 72.

In this embodiment, the cavity 210 is formed as the cushioning portion disposed between the holding surface 22 and the central area 51 of the lower surface of the wafer 5. In this respect, a pad of sponge rubber, an air bag or the like may be disposed as the cushioning portion in place of the cavity 210, for example, between the tape 8 and the holding surface 22. In this case, the frame unit 9 with the wafer 5 included therein is held on the chuck table 20 in the holding step without the formation of the cavity 210 between the holding surface 22 and the central area 51 of the lower surface of the wafer 5.

In this case, the controller 3 calculates the origin point height Z0 of the grinding mechanism 70 using the thickness of the cushioning portion such as the pad of sponge rubber or the air bag instead of the thickness V1 of the cavity 210 in the above-mentioned equation (1) after the acquisition of the first height Z1 in the storing step.

Alternatively, a relatively thick, cushioning tape may be used as the tape 8 in the frame unit 9, so that the tape 8 may be used as the cushioning portion. Also in this case, the frame unit 9 with the wafer 5 included therein is held on the chuck table 20 in the holding step without the formation of the cavity 210 between the holding surface 22 and the central area 51 of the lower surface of the wafer 5.

In this case, the controller 3 calculates the origin point height Z0 of the grinding mechanism 70 in the storing step by subtracting the thickness W1 of the wafer 5 and the thickness T1 of the tape 8, the thicknesses W1 and T1 being known beforehand, from the first height Z1 which is the height of the grinding mechanism 70 when the lower surfaces of the grinding stones 77 have come into contact with the upper surface 6 of the wafer 5, according to the above-described equation (2) instead of the above-mentioned equation (1).

In this embodiment, the wafer 5 is handled in the form of the frame unit 9, so that the frame unit 9 with the wafer 5 included therein is held and supported on the chuck table 20 by holding the ring frame 7 of the frame unit 9 with the clamps 31 of the chuck table 20.

Figure 12:
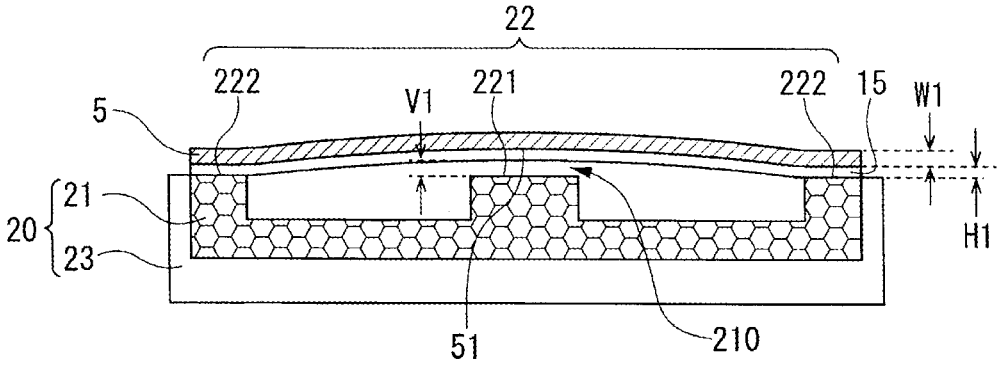
FIG. 12 is a cross-sectional view illustrating another configuration of the holding surface.

In this respect, Reference is now had to FIG. 12. FIG. 12 is a cross-sectional view illustrating another configuration of the holding surface 22. The wafer 5 can also be handled without providing it in the form of the frame unit 9. In this case, a holding surface 22 of a chuck table 20 may include, for example, a central holding surface 221 and an annular holding surface 222 as illustrated in FIG. 12.

With this configuration, the controller 3 holds, for example, the wafer 5 which includes the protective tape 15, at an outer peripheral portion thereof under suction on the annular holding surface 222 by controlling the suction valve 270 (see FIG. 2) to bring the suction source 240 into communication with the annular holding surface 222.

The controller 3 then controls the air valve 271 (see FIG. 2) to bring the air supply source 241 into communication with the central holding surface 221, whereby air is ejected from the central holding surface 221. A cavity 210 can therefore be formed as a cushioning portion between the holding surface 22 and the central area 51 of the lower surface of the wafer 5.

In this case, the controller 3 calculates the origin point height Z0 of the grinding mechanism 70 by subtracting the thickness V1 of the cavity 210, and the thickness W1 of the wafer 5 and a thickness H1 of the protective tape 15, the thicknesses W1 and H1 being known beforehand, from the first height Z1 of the grinding mechanism 70 according to the following equation (4) instead of the above-mentioned equation (1).

[Math. 4]

$$Z0=Z1-V1-W1-H1 \quad (4)$$

In this embodiment, the wafer 5 is used as the plate-shaped workpiece to be held on the holding surface 22 for performing a setup. In this respect, another plate-shaped workpiece such as a dresser board may also be held on the holding surface 22 instead of the wafer 5.

Further, as the height ascertainment device that ascertains the height of the grinding mechanism 70, a linear scale 25 illustrated in FIG. 1 may be used instead of the Z-axis encoder 65. The linear scale 25 includes a reading unit 26 and a scale portion 27. The reading unit 26 is disposed on the Z-axis moving table 63 of the lift mechanism 60 and moves together with the grinding mechanism 70 in the Z-axis direction. The scale portion 27 is disposed on a −Y direction side surface of one of the Z-axis guide rails 61, the one Z-axis guide rail 61 being located on a +X direction side. The reading unit 26 reads graduations of the scale portion 27, whereby the height of the grinding mechanism 70 moved in the Z-axis direction by the lift mechanism 60 can be ascertained.

The present invention is not limited to the details of the above-described preferred embodiment. The scope of the invention is defined by the appended claims and all changes and modifications as fall within the equivalence of the scope of the claims are therefore to be embraced by the invention.

What is claimed is:

1. A method for setting up a grinding apparatus, the grinding apparatus including a chuck table that holds a plate-shaped workpiece on a holding surface thereof, a grinding mechanism that has grinding stones mounted thereon and grinds, with the grinding stones, the plate-shaped workpiece held on the holding surface, a lift mechanism that moves the grinding mechanism in a direction vertical to the holding surface, an upper surface high gauge that includes a probe, and is arranged to be lifted with the grinding mechanism by the lift mechanism, and a height ascertainment device that ascertains a height of the grinding mechanism moved with the lift mechanism, by moving the grinding mechanism by the lift mechanism and storing the height of the grinding mechanism when lower surfaces of the grinding stones come into contact with the holding surface, the grinding mechanism including a contact detection section configured to detect contact of the lower surfaces of the grinding stones with an upper surface of the plate-shaped workpiece, the method comprising:

a holding step of holding the plate-shaped workpiece on the holding surface of the chuck table so that a cushioning portion is disposed between a central area of a lower surface of the plate-shaped workpiece and the holding surface;

a storing step of storing the height of the grinding mechanism when the lower surfaces of the grinding stones are ascertained through detection by the contact detection section to have come into contact with the upper surface of the plate-shaped workpiece that is held on the holding surface, the height of the grinding mechanism ascertained using an indication that the probe has come into contact with the upper surface of the plate-shaped workpiece, by lowering of the grinding mechanism with the grinding stones mounted thereon from above the plate-shaped workpiece held on the holding surface.

2. The method according to claim 1, wherein:

the grinding mechanism includes a rotation detection device that detects a rotational speed of the grinding stones, and the contact detection section detects the contact of the lower surfaces of the grinding stones with the upper surface of the plate-shaped workpiece, based on a decrease in the rotational speed of the grinding stones as detected by the rotation detection device.

3. The method according to claim 1, wherein, while lowering the grinding mechanism with the grinding stones thereon, the probe is configured and arranged to move downwardly under its own weight.

4. The method according to claim 1, wherein, while lowering the grinding mechanism with the grinding stones thereon, the probe is configured and arranged to come into contact with the upper surface of the plate-shaped workpiece before the lower surfaces of the grinding stones come into contact with the upper surface of the plate-shaped workpiece.

5. A method for setting up a grinding apparatus, the grinding apparatus including a chuck table that holds a plate-shaped workpiece on a holding surface thereof, a grinding mechanism that has grinding stones mounted thereon and grinds, with the grinding stones, the plate-shaped workpiece held on the holding surface, a lift mechanism that moves the grinding mechanism in a direction vertical to the holding surface, and a height ascertainment device that ascertains a height of the grinding mechanism moved with the lift mechanism, by moving the grinding mechanism by the lift mechanism and storing the height of the grinding mechanism when lower surfaces of the grinding stones come into contact with the holding surface, the grinding mechanism including a contact detection section configured to detect contact of the lower surfaces of the grinding stones with an upper surface of the plate-shaped workpiece, the method comprising:

a holding step of holding the plate-shaped workpiece on the holding surface of the chuck table so that a cushioning portion is disposed between a central area of a lower surface of the plate-shaped workpiece and the holding surface; and a storing step of storing the height of the grinding mechanism when the lower surfaces of the grinding stones are ascertained through detection by the contact detection section to have come into contact with the upper surface of the plate-shaped workpiece that is held on the holding surface, by lowering of the grinding mechanism with the grinding stones mounted thereon from above the plate-shaped workpiece held on the holding surface, and wherein:

the grinding apparatus further includes an upper-surface height gauge that measures a height of the upper surface of the plate-shaped workpiece held on the holding surface, the upper-surface height gauge is configured to be moved together with the grinding mechanism in the direction vertical to the holding surface by the lift mechanism, and the contact detection section is configured to detect the contact of the lower surfaces of the grinding stones with the upper surface of the plate-shaped workpiece by:

lowering the grinding mechanism, initiating a measurement of the height of the upper surface of the plate-shaped workpiece by the upper-surface height gauge before the lower surfaces of the grinding stones come into contact with the plate-shaped workpiece, continuing to lower the grinding mechanism to press the lower surfaces of the grinding stones against the upper surface of the plate-shaped workpiece, and ascertaining that an amount of a change in a value measured by the upper-surface height gauge no longer corresponds to an amount of a change in the height of the grinding mechanism obtained from the height ascertainment device associated with the lift mechanism.

6. The method according to claim 5, wherein the height ascertainment device comprises a z-axis encoder associated with the lift mechanism of the grinding mechanism.

7. The method according to claim 5, wherein, after initiating the measurement of the height of the upper surface of the plate-shaped workpiece, but before continuing to lower the grinding mechanism, the cushioning portion is formed based on control from a controller.

8. The method according to claim 7, wherein forming the cushioning portion comprises supplying air to create the cavity formed between the holding surface and the central area of the lower surface of the plate-shaped workpiece.

9. The method according to claim 7, wherein forming the cushioning portion comprises supplying water to create the cavity formed between the holding surface and the central area of the lower surface of the plate-shaped workpiece.

10. A method for setting up a grinding apparatus, the grinding apparatus including a chuck table that holds a plate-shaped workpiece on a holding surface thereof, a grinding mechanism that has grinding stones mounted thereon and grinds, with the grinding stones, the plate-shaped workpiece held on the holding surface, a lift mechanism that moves the grinding mechanism in a direction vertical to the holding surface, and a height ascertainment device that ascertains a height of the grinding mechanism moved with the lift mechanism, by moving the grinding mechanism by the lift mechanism and storing the height of the grinding mechanism when lower surfaces of the grinding stones come into contact with the holding surface, the grinding mechanism including a contact detection section configured to detect contact of the lower surfaces of the grinding stones with an upper surface of the plate-shaped workpiece, the method comprising:

a holding step of holding the plate-shaped workpiece on the holding surface of the chuck table so that a cushioning portion is disposed between a central area of a lower surface of the plate-shaped workpiece and the holding surface; and a storing step of storing the height of the grinding mechanism when the lower surfaces of the grinding stones are ascertained through detection by the contact detection section to have come into contact with the upper surface of the plate-shaped workpiece that is held on the holding surface, by lowering of the grinding mechanism with the grinding stones mounted thereon from above the plate-shaped workpiece held on the holding surface, such that a cavity of the cushioning portion collapses and wherein the cavity is formed based on control from a controller, between the holding surface and the central area of the lower surface of the plate-shaped workpiece.

11. The method according to claim 10, further comprising:

a cavity forming step of supplying air to create the cavity formed between the holding surface and the central area of the lower surface of the plate-shaped workpiece.

12. The method according to claim 10, further comprising:

a cavity forming step of supplying water to create the cavity formed between the holding surface and the central area of the lower surface of the plate-shaped workpiece.

* * * * *